US009229374B2

(12) United States Patent
Kakehi

(10) Patent No.: US 9,229,374 B2
(45) Date of Patent: Jan. 5, 2016

(54) IMAGE FORMING APPARATUS

(71) Applicant: CANON KABUSHIKI KAISHA, Tokyo (JP)

(72) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/693,290

(22) Filed: Apr. 22, 2015

(65) Prior Publication Data

US 2015/0309449 A1 Oct. 29, 2015

(30) Foreign Application Priority Data

Apr. 24, 2014 (JP) ..... 2014-090097
Feb. 19, 2015 (JP) ..... 2015-031159

(51) Int. Cl.
*G03G 15/16* (2006.01)
*G03G 15/00* (2006.01)

(52) U.S. Cl.
CPC ..... *G03G 15/1615* (2013.01)

(58) Field of Classification Search
CPC ..... G03G 15/1615
USPC ..... 399/302, 308, 316, 312, 313, 388
See application file for complete search history.

(56) References Cited

U.S. PATENT DOCUMENTS 4,739,362 A * 4/1988 Kau et al. ..... 399/316
5,617,193 A * 4/1997 Ban et al. ..... 399/316
6,449,444 B1 * 9/2002 Tanaka ..... 399/313
6,697,595 B2 2/2004 Kawagoe et al.
7,596,346 B2 * 9/2009 Kurosu et al. ..... 399/316
8,295,746 B2 * 10/2012 Matsumoto ..... 399/302
2003/0086733 A1 * 5/2003 Sawai et al. ..... 399/302
2006/0051139 A1 * 3/2006 Seo ..... 399/302
2007/0280750 A1 * 12/2007 Kurosu et al. ..... 399/316
2008/0019717 A1 * 1/2008 Soshiroda ..... 399/308
2009/0010675 A1 * 1/2009 Suzuki ..... 399/308

FOREIGN PATENT DOCUMENTS

JP 2002-082543 A 3/2002
JP 2010139603 A * 6/2010

OTHER PUBLICATIONS

Haruhiko Omata, U.S. Appl. No. 14/672,469, filed Mar. 30, 2015.
Yutaka Kakehi, U.S. Appl. No. 14/693,287, filed Apr. 22, 2015.
Yutaka Kakechi, U.S. Appl. No. 14/718,780, filed May 21, 2015.

* cited by examiner

*Primary Examiner* — Susan Lee
(74) *Attorney, Agent, or Firm* — Fitzpatrick, Cella, Harper & Scinto

(57) ABSTRACT

An image forming apparatus includes a pushing member pushing an image carrying belt from an inner circumferential side and a guide member guiding a recording medium toward a transfer nip portion formed with an inner-side roller and an outer-side roller. The guide member includes first and second guides and the second guide is provided such that a tip end on the side of the transfer nip portion is positioned further away from the image carrying belt than a reference line that connects a point at which a line connecting the rotational center of the inner-side roller and the rotational center of the outer-side roller intersects with the image carrying belt, and a furthest downstream contact point of a contact area in which the pushing member contacts with the image carrying belt.

8 Claims, 7 Drawing Sheets

IMAGE FORMING APPARATUS

BACKGROUND OF THE INVENTION

1. Field of the Invention

This disclosure relates to an image forming apparatus that transfers a toner image carried on an image carrier onto a recording medium.

2. Description of the Related Art

There is known an image forming apparatus configured to form a toner image carried on a rotating endless belt-like intermediate transfer member (hereinafter, referred to as an intermediate transfer belt) and transfer the toner image onto a recording medium at a transfer nip portion at which a rotating transfer member (transfer belt or transfer roller) is in contact with the intermediate transfer belt. In order to transfer the toner image onto the recording medium from the intermediate transfer belt, a high voltage is applied to the rotating transfer member and thus, a high electric field is produced at the transfer nip portion. The recording medium is guided to the transfer nip portion along the intermediate transfer belt by a conveyer guide.

The intermediate transfer belt vibrates during rotation in some cases. When the intermediate transfer belt vibrates, a gap may be formed between a toner image carrying surface of the intermediate transfer belt and the recording medium at upstream of the transfer nip portion (upstream side of the intermediate transfer belt in a rotating direction). As described above, since the high electric field is produced at the transfer nip portion, an abnormal electrical discharge may occur between the intermediate transfer belt and the recording medium in a case where the gap is formed upstream of the transfer nip portion. When the abnormal electrical discharge occurs, a charge of the toner carried on the intermediate transfer belt is lost and the toner which has lost charge is not transferred onto the recording medium from the intermediate transfer belt. Then, an image defect (referred to as a void, a white space, or the like) like an empty white portion is caused at a position where an abnormal electrical discharge occurs. Therefore, as disclosed in JP-A-2002-82543, an apparatus is proposed, in which a pushing member is provided on an inner circumferential side (back surface side opposite to a toner image carrying surface) of an intermediate transfer belt, pushes the intermediate transfer belt from the back surface, and stretches the belt to a rotating transfer member side, and thereby vibration of the intermediate transfer belt which causes an abnormal electrical discharge is suppressed.

However, when the intermediate transfer belt is greatly stretched by the pushing member, a recording medium guided by a conveyer guide becomes closer to the intermediate transfer belt. In such a case, when the recording medium is, particularly, cardboard, coated paper, or the like, which has high bending stiffness, the recording medium collides with the intermediate transfer belt on the upstream side from the pushing member in a rotating direction of the intermediate transfer belt and the recording medium is bent and thus, the recording medium and the intermediate transfer belt strongly rub against each other. When the recording medium and the intermediate transfer belt strongly rub against each other, an unfixed toner image carried on the intermediate transfer belt is disturbed. As a result, an image defect referred to as "deterioration of graininess" or the like appears on the recording medium after transferring.

SUMMARY OF THE INVENTION

According to an aspect of this invention, an image forming apparatus includes an endless image carrying belt rotating while carrying a toner image on a surface thereof, an inner-side roller provided on the inner circumferential side of the image carrying belt and coming into contact with the image carrying belt, a stretching member provided upstream, in a rotating direction of the image carrying belt, of the inner-side roller and stretching the image carrying belt from the inner circumferential side, a pushing member provided upstream the inner-side roller and downstream the stretching member in the rotating direction of the image carrying belt, and coming into contact with and pushing the image carrying belt from the inner circumferential side such that an stretching surface of the image carrying belt which is formed between the inner-side roller and the stretching member is jutted to the outer side, an outer-side roller provided to face the inner-side roller with the image carrying belt nipped therebetween, forming a transfer nip portion with the inner-side roller, and transferring a toner image onto a recording medium from the image carrying belt while the recording medium is nipped and conveyed at the transfer nip portion, and a guide member guiding the recording medium toward the transfer nip portion. The guide member includes a first guide provided upstream the transfer nip portion in the rotating direction of the image carrying belt and on the outer side of the image carrying belt, and a second guide provided between the first guide and the image carrying belt and of which a tip end on the side of the transfer nip portion is positioned further away from the image carrying belt than from a reference line that connects a point at which a line connecting the rotational center of the inner-side roller and the rotational center of the outer-side roller intersects with the image carrying belt, and a furthest downstream contact point of a contact area in which the pushing member contacts with the image carrying belt.

Further features of the present invention will become apparent from the following description of exemplary embodiments with reference to the attached drawings.

DESCRIPTION OF THE EMBODIMENTS

Hereinafter, embodiments of this disclosure will be described in detail with reference to the drawings.

As long as a pushing member pushes an intermediate transfer belt from a back surface (side opposite to a toner image carrying surface) and suppresses vibration of the intermediate transfer belt, this disclosure is implemented as another embodiment in which a configuration of the embodiment of this disclosure is partially or entirely replaced with an alternative configuration.

Thus, it is possible to achieve an image forming apparatus as long as the apparatus uses an intermediate transfer belt, regardless of a tandem system/one drum system, a charging system, electrostatic image forming system, a developing system, a transfer system, or a fixing system. According to the embodiment of this disclosure, although only main parts related to forming/transferring of a toner image are described, this disclosure can be implemented in various ways such as a printer, any of various printing machines, a copier, a facsimile machine, or a multi-purpose printer, including a required device, equipment, or housing structure.

First Embodiment

Figure 2:
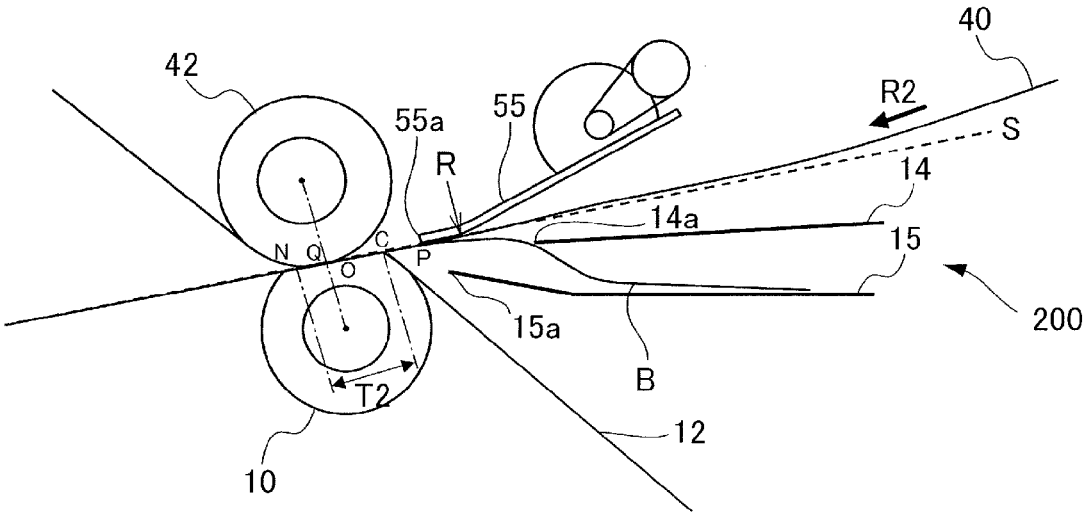
FIG. 2 is a view schematically illustrating a pushing member and a conveyer guide.
Figure 3:
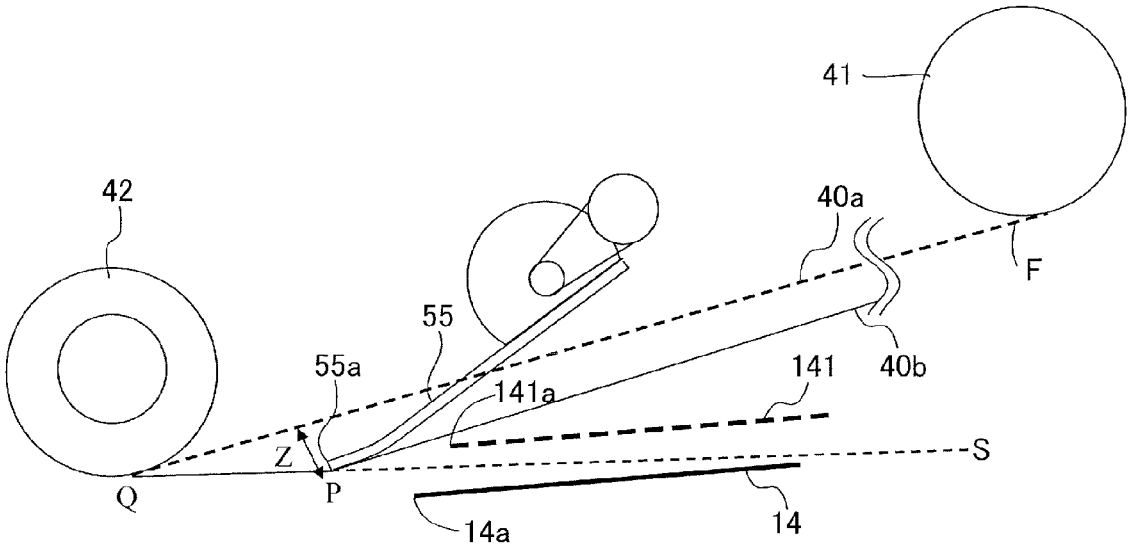
FIG. 3 is a view illustrating the pushing member and the conveyer guide.

An image forming apparatus of a first embodiment of the present invention will be described with reference to FIGS. 1 through 3. At first, a schematic structure of the image forming apparatus of the present embodiment will be described with reference to FIG. 1.

<Image Forming Apparatus>

Figure 1:
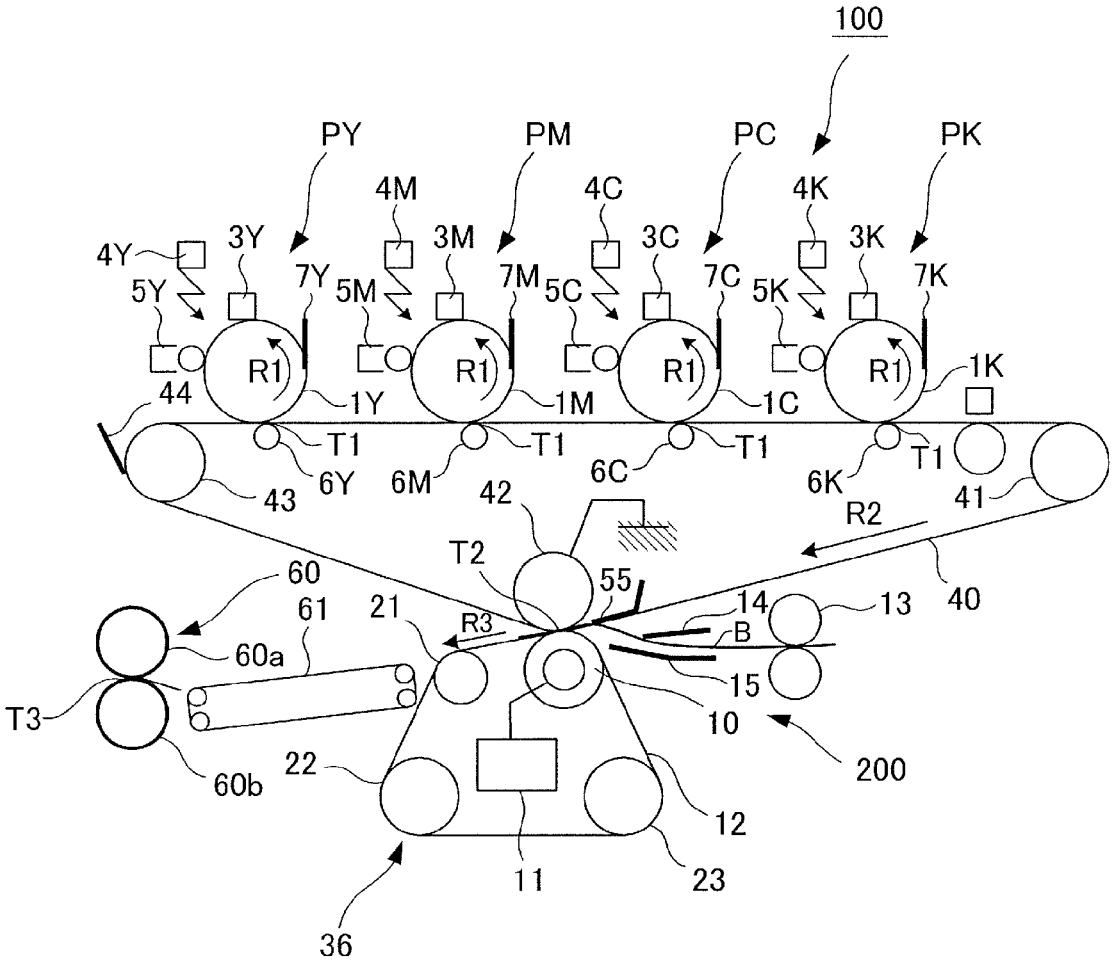
FIG. 1 is a view schematically illustrating a configuration of an image forming apparatus according to a first embodiment.

An image forming apparatus 100 illustrated in FIG. 1 is a tandem intermediate transfer type full-color printer in which image forming portions PY, PM, PC, and PK of yellow, magenta, cyan, and black are arranged along an intermediate transfer belt 40.

In the image forming portion PY, a yellow toner image is formed on a photoconductive drum 1Y as a photoconductive member and is transferred (primarily transferred) onto the intermediate transfer belt 40. In the image forming portion PM, a magenta toner image is formed on a photoconductive drum 1M and is superimposed on and transferred onto the yellow toner image on the intermediate transfer belt 40. In the image forming portions PC and PK, a cyan toner image and a black toner image are formed on photoconductive drums 1C and 1K, respectively, and are superimposed on and transferred onto the intermediate transfer belt 40 in this order.

The image forming portions PY, PM, PC, and PK are configured to be substantially the same as each other except that colors of toner used in developing units 5Y, 5M, 5C, and 5K are differently yellow, magenta, cyan, and black. Hereinafter, a reference number without the last letters Y, M, C, and K which indicates a distinction between the image forming portions PY, PM, PC, and PK is attached to the corresponding component and a configuration and an operation of the image forming portions PY, PM, PC, and PK will be collectively described.

In each of the image forming portions PY, PM, PC, and PK, a corona charger 3, an exposing unit 4, a developing unit 5, a primary transfer roller 6, and a drum cleaning unit 7 are disposed around a photoconductive drum 1. The photoconductive drum 1 has a photoconductive layer formed on the outer circumferential surface thereof and rotates in an arrow R1 direction at a predetermined process speed.

The corona charger 3 performs, for example, irradiation of charged particles from a corona discharge and causes a surface of the photoconductive drum 1 to be charged to a constant negative-polarity dark potential. The exposing unit 4 performs scanning of a laser beam produced through ON-OFF modulation of scanning line image data obtained by developing respective colors of resolved color images by using a revolving mirror and writes an electrostatic latent image on the charged surface of the photoconductive drum 1. Since the electrostatic latent image written on the photoconductive drum 1 by the exposing unit 4 is a collection of small dot images, it is possible to change a density of toner images formed on the surface of the photoconductive drum 1 when the density of the dot images is changed. For example, an amount of toner per unit area is about 0.4 mg/cm$^2$ to 1.6 mg/cm$^2$ in a case where each color toner image has the maximum density of about 1.5 to 1.7.

The developing unit 5 supplies toner to the photoconductive drum 1 and develops the electrostatic latent image into a toner image. The developing unit 5 causes a developing sleeve (not illustrated) disposed with a slight interval from the surface of the photoconductive drum 1 to rotate in a direction counter to that of the photoconductive drum 1. The developing unit 5 causes a two-component developer containing toner and a carrier to be charged and to be carried on the developing sleeve and the developer is transported to a portion facing the photoconductive drum 1. An oscillation voltage formed by superposing an AC voltage on a DC voltage is applied to the developing sleeve and thereby negative-polarity-charged non-magnetic toner is moved to a relatively positive-polarity exposing portion of the photoconductive drum 1 and an electrostatic image is reversely developed.

The primary transfer roller 6 comes into pressurized contact with the intermediate transfer belt 40 and forms a primary transfer portion (nip) T1 between the photoconductive drum 1 and the intermediate transfer belt 40. A positive-polarity DC voltage is applied to the primary transfer roller 6 and thereby, a negative-polarity toner image on the photoconductive drum 1 is transferred onto the intermediate transfer belt 40. The primary transfer roller 6 comes into contact with the intermediate transfer belt 40 supported by the photoconductive drum 1 with a total load of, for example, 10 N (1 kgf) and rotates following the intermediate transfer belt 40. The primary transfer roller 6 utilizes a resilient roller which has a resilient layer formed of semi-conductive polyurethane foamed rubber on a metal shaft and a circumferential surface has an Asker C hardness of 10 degrees and roller resistance is $1\times10^6\Omega$. The roller resistance is calculated from a current flowing through a metal plate in a condition in which a weight of 500 g is placed on each of the opposite ends of the metal shaft of the primary transfer roller 6 and presses against the metal plate grounded via an ammeter, and a voltage of 2 kV is applied to one end of the metal shaft in an environment of a temperature of 23° C. and a relative humidity of 50% RH.

The drum cleaning unit 7 collects residual toner which has passed through the primary transfer portion T1 and remains on the surface of the photoconductive drum 1. The drum cleaning unit 7 causes a polyurethane cleaning blade (not illustrated) which has a durometer A hardness of 70 degrees and a thickness of 2 mm to rub against the photoconductive drum 1.

<Intermediate Transfer Belt>

The intermediate transfer belt 40 as an image carrying belt is an endless belt-like intermediate transfer member which comes into contact with the photoconductive drum 1 and rotates, for example, at 250 mm/sec to 300 mm/sec in an arrow R2 direction in the drawings. The intermediate transfer belt 40 is formed in an endless shape using a resin material and a tension roller 41 as a stretching member, an inner secondary transfer roller 42 as an inner-side roller, and a drive roller 43 are provided so as to be in contact with the inner circumferential side of the intermediate transfer belt 40. The intermediate transfer belt 40 is extended by the tension roller 41, the inner secondary transfer roller 42, and the drive roller 43 by a constant tensile force. For example, a pressing force against the intermediate transfer belt 40 by a resilient member like a spring (not illustrated) from the back surface to the surface of the intermediate transfer belt is applied to the tension roller 41 and the intermediate transfer belt 40 is extended by a tensile force of about 2 kg to 5 kg. According to the embodiment of this disclosure, the tension roller 41 is disposed upstream from the inner secondary transfer roller 42 in the rotating direction of the intermediate transfer belt 40 and the intermediate transfer belt 40 is extended between the tension roller 41 and the inner secondary transfer roller 42. In addition, the tension roller 41 extends the intermediate transfer belt 40 with the drive roller 43 disposed upstream from the tension roller 41 in the rotating direction of the intermediate transfer belt 40. The back surface of the intermediate transfer belt 40 indicates a surface on the side opposite to the surface (toner image carrying surface) of the intermediate transfer belt 40 on which a toner image is carried, that is, the surface on the inner circumferential side.

The intermediate transfer belt 40 is an endless belt with a three-layer structure of a resin layer, a resilient layer, and a top layer which are formed from the back surface side in this order. The resin layer is formed of a resin material such as polyimide or polycarbonate and has a thickness of 70 μm to 100 μm. The resilient layer is formed of a resilient material such as urethane rubber or chloroprene rubber and has a thickness of 200 μm to 250 μm. The top layer is formed of a material which produces a low attachment force of toner on the surface of the intermediate transfer belt 40 and causes the toner to be likely to be transferred onto a recording medium B at a secondary transfer nip portion T2. For example, any one type of resin material such as polyurethane, polyester, and epoxy resin may be used. Alternatively, two or more types of resilient materials such as elastic rubber, an elastomer, and butyl rubber may be used. In a case where an elastic material is used, a material which has a low surface energy and an enhanced lubricating property, for example, powder such as a fluorine resin which is formed by dispersing and mixing one type or two or more types of particles or different particle sizes of the particles may be used. The top layer has a thickness of 5 μm to 10 μm. In addition, a conductive agent for resistance value adjustment such as carbon black is added to the intermediate transfer belt 40 and a volume resistivity is adjusted to $1\times10^{9}$ Ω·cm to $1\times10^{14}$ Ω·cm.

The registration roller 13 sends the recording medium B to the secondary transfer nip portion T2 as a transfer nip portion at a timing set based on the toner image on the intermediate transfer belt 40. At a destination to which the registration roller 13 sends the recording medium B, a conveyer guide 200 is provided such that an upper guide 14 and a lower guide 15 face each other and the recording medium B is sent between the upper guide 14 and the lower guide 15 of the conveyer guide 200. The conveyer guide 200 which has the upper guide 14 and the lower guide 15 regulates a moving direction of the recording medium B sent by the registration roller 13 and guides the recording medium B toward the secondary transfer nip portion T2. The upper guide 14 on the side (image carrying belt side) closer to the intermediate transfer belt 40 regulates an approaching movement of the recording medium B to the intermediate transfer belt 40 and the lower guide 15 on the side away from the intermediate transfer belt 40 regulates a movement of the recording medium B away from the intermediate transfer belt 40.

A four-color toner image carried on the intermediate transfer belt 40 is transported to the secondary transfer nip portion T2 and is secondarily transferred collectively onto the recording medium B at the secondary transfer nip portion T2. The secondary transfer belt 12 conveys the recording medium B such that the toner image on the intermediate transfer belt 40 is superposed on the recording medium B and causes the recording medium B to pass through the secondary transfer nip portion T2. The recording medium B on which the four-color toner image is secondary-transferred by the secondary transfer nip portion T2 is sent to a conveyer belt 61 from the secondary transfer nip portion T2. The conveyer belt 61 supports the recording medium B sent from the secondary transfer nip portion T2 on the side opposite to a surface on which the toner image is transferred and guides the recording medium B to a fixing unit 60.

The fixing unit 60 as a fixing portion forms a fixing nip portion T3 as a fixing nip portion by two rotating members (60*a* and 60*b*) coming into contact with each other and the toner image is fixed on the recording medium B while the recording medium B is transported at the fixing nip portion T3. In the fixing unit 60, a pressurizing roller 60*b* is caused, by an urging mechanism (not illustrated) to come into pressurized contact with a heating roller 60*a* which is heated by a lamp heater or the like (not illustrated) from the inner side thereof and the fixing nip portion T3 is formed. The recording medium B is heated/pressurized by being nipped and transported at the fixing nip portion T3 such that the toner image is fixed to the recording medium B. The recording medium B to which the toner image is fixed by the fixing unit 60 is discharged to the outside of the apparatus body.

A belt cleaning unit 44 causes a cleaning blade to rub against the intermediate transfer belt 40 and collects residual toner which has passed through the secondary transfer nip portion T2 and then remains on the intermediate transfer belt 40. The belt cleaning unit 44 causes a tip end of a polyurethane cleaning blade which has a durometer A hardness of 75 degrees and a thickness of 2 mm to come into contact with the surface of the intermediate transfer belt 40 in the direction counter to the surface. The belt cleaning unit 44 not only collects the residual toner on the intermediate transfer belt 40 which has passed through the secondary transfer nip portion T2 without being transferred onto the recording medium B but also removes paper powder or the like which is attached to the intermediate transfer belt 40 from the recording medium B at the secondary transfer nip portion T2, from the intermediate transfer belt 40.

<Secondary Transfer Belt Unit>

A secondary transfer belt unit 36 includes a secondary transfer belt 12 as the transfer belt, a secondary transfer roller 10, an extension roller 21, a drive roller 22, and a tension roller 23. The secondary transfer roller 10, the extension roller 21, the drive roller 22, and the tension roller 23 are provided on the inner circumferential side of the secondary transfer belt 12. The secondary transfer roller 10 forms the secondary transfer nip portion T2 between the secondary transfer roller 10 and the inner secondary transfer roller 42. Here, the secondary transfer nip portion T2 is formed between the secondary transfer roller 10 and the inner secondary transfer roller 42 with the secondary transfer belt 12 and the intermediate transfer belt 40 nipped therebetween. A transfer electric field is produced at the secondary transfer nip portion T2 and thereby, the toner image on the intermediate transfer belt 40 is transferred to the recording medium B. The secondary transfer belt 12 is formed to be endless belt-like using a resin material having high resistivity and is extended by the secondary transfer roller 10, the extension roller 21, the drive roller 22, and the tension roller 23. The secondary transfer belt 12 is synchronized with the intermediate transfer belt 40 and rotates in an arrow R3 direction in the drawing and causes the recording medium B sent by the registration roller 13 to pass through the secondary transfer nip portion T2 and to be transported to the side of the conveyer belt 61. The secondary transfer belt 12 is charged and comes into close contact with the recording medium B when the toner image on the intermediate transfer belt 40 is transferred onto the recording medium B, and the recording medium B on which an unfixed toner image is carried is separated from the intermediate transfer belt 40 and is sent to the conveyer belt 61.

The secondary transfer roller 10 as an outer-side roller is disposed at a position shifted to the upstream side from the inner secondary transfer roller 42 in the rotating direction of the intermediate transfer belt 40 by 0 mm to 4 mm. The secondary transfer roller 10 comes into pressurized contact with the inner secondary transfer roller through the intermediate transfer belt 40 and the secondary transfer belt 12 and forms the secondary transfer nip portion T2 between the secondary transfer roller 10 and the intermediate transfer belt 40.

The secondary transfer roller 10 is formed by using a roller member in which a resilient layer of an ionic semi-conductive foamed rubber (NBR rubber) is formed on the metal shaft and the outer circumferential surface has an Asker C hardness of 30 degrees to 40 degrees and a roller resistance of $1\times10^5\Omega$ to $1\times10^7\Omega$. As above, the secondary transfer roller 10 comes into contact with the inner secondary transfer roller 42 or the intermediate transfer belt 40 while being deformed. Hence, the secondary transfer roller 10 can be deformed depending on the stretching of the intermediate transfer belt 40 by a pushing member 55 which will be described below. In addition, in a case or the like in which the secondary transfer roller 10 and the inner secondary transfer roller 42 are offset, the intermediate transfer belt 40 comes into contact with only the secondary transfer roller 10 and a region that forms the secondary transfer nip portion T2 can be formed. The outer diameter of the secondary transfer roller 10 is, for example, 24 mm and deterioration of graininess of the roller surface is, for example, 6.0 μm to 12.0 μm. In addition, a contact pressure of the secondary transfer roller 10 to the inner secondary transfer roller 42 is about 50 N.

A secondary transfer high-voltage power supply 11 of which a supply bias is variable is connected to the secondary transfer roller 10. The inner secondary transfer roller 42 is connected to a ground potential (0 V) and a positive-polarity voltage (secondary transfer voltage) which is a polarity opposite to that of the toner is applied to the secondary transfer roller 10 by the secondary transfer high-voltage power supply 11 and thereby, the transfer electric field is produced at the secondary transfer nip portion T2. In response to the transfer electric field, the negative-polarity toner images of yellow, magenta, cyan, and black which are carried on the intermediate transfer belt 40 are collectively secondary-transferred onto the recording medium B. The recording medium B is adsorbed to the secondary transfer belt 12 due to static electricity produced on the secondary transfer belt 12 by applying of the secondary transfer voltage. The recording medium B adsorbed onto the surface of the secondary transfer belt 12 is separated from a surface of the secondary transfer belt 12 due to curvature of a curved surface of the secondary transfer belt 12 along the extension roller 21 provided on the downstream side in a conveying direction of the recording medium B and the recording medium B is delivered to the conveyer belt 61.

<Pushing Member>

In the image forming apparatus 100 according to the embodiment of this disclosure, the pushing member 55 which pushes the intermediate transfer belt 40 from the back surface of the intermediate transfer belt 40 on the upstream side of the secondary transfer nip portion T2 in the rotating direction of the intermediate transfer belt 40 and stretches (juts) the intermediate transfer belt 40 to the surface side (toner image carrying surface side) is disposed. The pushing member 55 is supported by a transfer unit frame (not illustrated) to which the tension roller 41 which extends the intermediate transfer belt 40, the inner secondary transfer roller 42, and the drive roller 43 are assembled, or a frame (not illustrated) of an apparatus body of the image forming apparatus. The pushing member 55 is described with reference to FIG. 2 and FIG. 3. The secondary transfer roller 10, the secondary transfer belt 12, and the lower guide 15 are omitted from FIG. 3.

The pushing member 55 as a pushing member is formed to have a plate shape using a resin material such as polyester. As an example, the pushing member 55 is formed to have a thickness of 0.4 mm to 0.6 mm and a width of 330 mm to 380 mm such that the entire width of the member can come into contact with the entire width of the intermediate transfer belt 40. In a case where the pushing member 55 is formed by using a PET resin sheet and the PET resin sheet has low electrical resistance, there is a concern that a current may flow in the pushing member 55 due to application of the secondary transfer voltage to the secondary transfer roller 10 and transfer failure may occur. On the contrary, when the PET resin sheet having high electrical resistance is used, static electricity (frictional charging) is produced due to friction between the pushing member 55 and the intermediate transfer belt 40 and the intermediate transfer belt 40 is adsorbed to the pushing member 55, and thereby, the rotation of the intermediate transfer belt 40 may be disturbed. Therefore, the PET resin sheet which is adjusted to have medium electrical resistance may be used for the pushing member 55.

The pushing member 55 is provided so as to cause the recording medium B and the intermediate transfer belt 40 to come into close contact with each other at upstream (the upstream side in the rotating direction of the intermediate transfer belt 40) of the secondary transfer nip portion T2. Therefore, a pushing amount by which no gap is produced between the recording medium B and the intermediate transfer belt 40 is determined in advance and the pushing member 55 is disposed at a vertical position (a position in the vertical direction in the drawings) in accordance with the pushing amount. As illustrated in FIG. 3, the pushing amount is a jutting amount (stretching amount) Z from a virtual stretching surface 40*a* of the intermediate transfer belt 40 to an actual stretching surface 40*b* of the intermediate transfer belt 40. The virtual stretching surface 40*a* of the intermediate transfer belt 40 is a surface formed between the inner secondary transfer roller 42 and the tension roller 41 in a case no pressure is applied by the pushing member 55. On the other hand, the stretching surface 40*b* is an actual stretching surface of the intermediate transfer belt 40 which is formed between the inner secondary transfer roller 42 and the tension roller 41 in a case where the stretching surface 40*b* is actually pushed by the pushing member 55. The pushing member 55 is provided at any vertical position from which the intermediate transfer belt 40 is stretched toward the surface side (toner image carrying surface side) by, for example, 1.0 mm to 3.0 mm. As above, the stretching surface of the intermediate transfer belt 40 which is formed between the tension roller 41 and the inner secondary transfer roller 42 is jutted to the outer side from the virtual stretching surface 40*a* by the pushing member 55. In other words, the intermediate transfer belt 40 is stretched to jut toward the outer side from a common tangent line F in contact with the tension roller 41 and the inner secondary transfer roller 42 on the side on which the intermediate transfer belt 40 is stretched by each of the tension roller 41 and the inner secondary transfer roller 42.

In addition, the pushing member 55 is disposed at a predetermined horizontal position (position in a horizontal direction in the drawings). To be more specific, as illustrated in FIG. 2, the pushing member 55 is disposed such that a tip end 55*a* is positioned toward the upstream side in the rotating direction of the intermediate transfer belt 40 at a distance of 3 mm to 15 mm away from an entrance C of the secondary transfer nip portion T2. That is, if the tip end 55*a* of the pushing member 55 is positioned at, for example, a position O which is an upstream end position, in the rotating direction of the intermediate transfer belt 40, of the range contacting the intermediate transfer belt 40 and the inner secondary transfer roller 42 to each other, there may be interference with the driving of the inner secondary transfer roller 42. In addition, if the tip end 55*a* of the pushing member 55 is positioned in a range from the position O to the entrance C of the secondary transfer nip portion T2, there may be interference with driving of the secondary transfer roller 10. If there is interference with the driving of the inner secondary transfer roller 42 or the secondary transfer roller 10, the intermediate transfer belt 40 is not smoothly driven. In this case, if the primary transfer or the secondary transfer is performed, the toner image is likely to be shifted from a predetermined position. Thus, the pushing member 55 is disposed such that the tip end 55*a* thereof is positioned at a distance of 3 mm to 15 mm away from the entrance C of the secondary transfer nip portion T2 as described above. Further, the pushing member 55 is disposed in a direction in which there is no interference with the rotation of the intermediate transfer belt 40, that is, the tip end 55*a* of the pushing member 55 directs toward the downstream side in the rotating direction of the intermediate transfer belt 40. Therefore, the pushing member 55 comes into contact with the intermediate transfer belt 40 in a forward direction along the rotating direction R2. In addition, since the pushing member 55 pushes the intermediate transfer belt 40 while being deflected on the tip end 55*a* side, the pushing member is in contact with the intermediate transfer belt 40 in a certain range (range PR in FIG. 2). The position O and the entrance C of the secondary transfer nip portion T2 described above may be the same position.

In some cases, the recording medium B is transported to a position closer to the intermediate transfer belt 40 than a reference line S that passes through a position Q of the secondary transfer nip portion T2 and the furthest downstream pushing position P. The position Q of the secondary transfer nip portion T2 is a point (first point) at which a line connecting a rotational center of the inner secondary transfer roller 42 to a rotational center of the secondary transfer roller 10 intersects with the intermediate transfer belt 40. The furthest downstream pushing position P (second point) is a contact position (contact point) with the pushing member 55 in the furthest downstream in the rotating direction of the intermediate transfer belt 40 in the contact area PR between the pushing member 55 and the intermediate transfer belt 40. On the contrary, a contact position (contact point) with the pushing member 55 in the furthest upstream in the rotating direction of the intermediate transfer belt 40 of the contact area PR is referred to as the furthest upstream pushing position R. The reference line S is a line passing through the position Q and the position P when the pushing member 55 comes into contact with and pushes the intermediate transfer belt 40 from the inner circumferential side of the intermediate transfer belt 40 such that the intermediate transfer belt is jutted to the outer side (surface side) between the inner secondary transfer roller 42 and the tension roller 41 (refer to FIG. 3). However, the recording medium B is likely to be in a state in which the recording medium collides with the intermediate transfer belt 40 and is bent on the upstream side from the furthest downstream pushing position P in the rotating direction of the intermediate transfer belt 40 due to the pushing amount of the pushing member 55. When the recording medium B is, particularly, cardboard, coated paper, or the like, which has high bending stiffness, the recording medium B is likely to enter into this state. In this state, the recording medium B and the intermediate transfer belt 40 strongly collide against each other and, thus, are likely to rub against each other. When the recording medium B and the intermediate transfer belt 40 rub against each other, an unfixed toner image carried on the intermediate transfer belt 40 is disturbed. As a result, so-called "deterioration of graininess" occurs, which causes the image on the recording medium B after the secondary transfer to be disturbed.

Here, a case where the furthest downstream pushing position P coincides with a position of the tip end 55*a* of the pushing member 55 is illustrated; however, the positional relationship is not limited thereto. The furthest downstream pushing position P and the position of the tip end 55*a* of the pushing member 55 may not coincide with each other. Examples of the recording medium B with high bending stiffness include cardboard, coated paper, an OHP sheet, or the like which has a basis weight of 200 g/m$^2$ or greater.

The inventors of this disclosure carried out experiments in which cardboard having a basis weight of 200 g/m$^2$ or greater passes through the apparatus so as to search for a relationship between the pushing amount of the pushing member 55 and an image defect (void, deterioration of graininess) produced on the recording medium B. The results of the experiment are shown in Table 1. Table 1 shows the results of the experiment in a case where, similar to an upper guide 141 illustrated in FIG. 3, a tip end 141*a* is positioned on the side closer to the intermediate transfer belt 40 (stretching surface 40*b*) than to the reference line S. Table 2 shows the results of the experiment in a case where, similar to the upper guide 14 illustrated in FIG. 3, an upper guide is disposed such that the tip end 14*a* is disposed on the side further away from the intermediate transfer belt 40 (stretching surface 40*b*) than from the reference line S.

TABLE 1

| | pushing Amount (mm) | | | | |
|---|---|---|---|---|---|
| | 0.0 | 0.5 | 1.0 | 1.5 | 2.0 |
| Void | Present | Present | Not Present | Not Present | Not Present |
| Deterioration of graininess | Not Present | Not Present | Present | Present | Present |

TABLE 2

| | pushing Amount (mm) | | | | |
|---|---|---|---|---|---|
| | 0.0 | 0.5 | 1.0 | 1.5 | 2.0 |
| Void | Present | Present | Not Present | Not Present | Not Present |
| Deterioration of graininess | Not Present | Not Present | Not Present | Not Present | Not Present |

As shown in Table 1 and Table 2, in a case where the pushing amount of the pushing member 55 by which the intermediate transfer belt 40 is pushed from the virtual stretching surface 40*a* to the stretching surface 40*b* is less than 1.0 mm, a "void" appears due to an abnormal electrical discharge between the recording medium B and the intermediate transfer belt 40. On the other hand, in a case where the pushing amount of the pushing member 55 is 1.0 mm or greater, no voids appear. From the results of the experiment, when the pushing amount of the pushing member 55 is set to be 1.0 mm or greater, it can be understood that fewer voids appear when the stretching surface 40*b* of the intermediate transfer belt 40 is greatly stretched to the outer side. However, when the pushing amount of the pushing member 55 becomes excessively increased, the pushing member 55 increases a load applied on the contact surface with the intermediate transfer belt 40 and thus, it is unlikely for the intermediate transfer belt 40 to be able to rotate smoothly. In order to avoid the above state, it is desirable that the pushing amount of the pushing member 55 is suppressed to be 3.0 mm or less, for example. Taking the above state into account, the pushing member 55 is provided at any vertical position at which the intermediate transfer belt 40 is stretched by a pushing amount of 1.0 mm to 3.0 mm, as already described.

In addition, as understood by comparison of Table 1 and Table 2, in a case where the upper guide 141 is disposed and the pushing amount of the pushing member 55 is 1.0 mm or greater, "deterioration of graininess" due to the rubbing of the recording medium B against the intermediate transfer belt 40 appears (refer to Table 1). However, when the upper guide 14 is disposed (refer to Table 2), "deterioration of graininess" does not appear regardless of the pushing amount of the pushing member 55. Due to this fact, it is considered that the disposition of the conveyer guide 200 (to be more specific, upper guide 14) has an effect on the "deterioration of graininess". Hereinafter, the disposition of the conveyer guide 200 will be described.

<Conveyer Guide>

In the image forming apparatus 100 according to the embodiment of this disclosure, the image defect of "deterioration of graininess" due to the rubbing of the recording medium B against the intermediate transfer belt 40 is prevented from occurring by the conveyer guide 200. As illustrated in FIG. 2, the recording medium B is in a state of being nipped at the secondary transfer nip portion T2 and is guided by the conveyer guide 200 so as to be further away from the intermediate transfer belt 40 than from the reference line S on upstream from the furthest downstream pushing position P in the rotating direction of the intermediate transfer belt 40. In this manner, the conveyer guide 200 is disposed.

The conveyer guide 200 as a guide member includes the upper guide 14 that regulates an approaching movement of the recording medium B toward the intermediate transfer belt 40 and the lower guide 15 that regulates a movement of the recording medium B away from the intermediate transfer belt 40. The upper guide 14 as a second guide and the lower guide 15 as a first guide are disposed vertically in two stages on the outer side (surface side) of the intermediate transfer belt 40 along the conveying direction of the recording medium B. The upper guide 14 is disposed between the lower guide 15 and the intermediate transfer belt 40. The upper guide 14 is disposed such that the tip end 14*a* thereof on the secondary transfer nip portion side (transfer nip portion side and the downstream side in the conveying direction of the recording medium B) is positioned upstream from the furthest downstream pushing position P in the rotating direction of the intermediate transfer belt 40 and on the side further away from the intermediate transfer belt 40 than from the reference line S. That is, the upper guide 14 is disposed such that the tip end 14*a* thereof is positioned on the side further away from the intermediate transfer belt 40 than from the reference line S, regardless of the position of the stretching surface 40*b* (refer to FIG. 3) of the intermediate transfer belt 40 which is changed depending on the pushing amount of the pushing member 55. On the other hand, the lower guide 15 is disposed so as to face the upper guide 14 and at the position further away from the intermediate transfer belt 40 than from the upper guide 14. In addition, the lower guide 15 is disposed such that a tip end 15*a* on the downstream side in the conveying direction of the recording medium B is positioned to be closer to the secondary transfer nip portion T2 than to the furthest upstream pushing position R.

In addition, the upper guide 14 is disposed on the upstream side from the furthest downstream pushing position P in the rotating direction of the intermediate transfer belt 40. This is because a gap is formed between the recording medium B and the intermediate transfer belt 40 and the image defect such as the void occurs due to the abnormal electrical discharge at the position when the recording medium B does not come into contact with the intermediate transfer belt 40 over a certain length upstream the secondary transfer nip portion T2. In order to prevent an image defect, the recording medium B may be guided so as to follow the intermediate transfer belt 40 over a length of 5 mm to 10 mm upstream the secondary transfer nip portion T2. Therefore, the upper guide 14 is provided on the upstream side from the furthest downstream pushing position P in the rotating direction of the intermediate transfer belt 40.

According to the disposition of the conveyer guide 200, the recording medium B is guided by the conveyer guide 200 toward the secondary transfer nip portion T2 from the side further away from the intermediate transfer belt 40 than from the reference line S upstream from the furthest downstream pushing position P in the rotating direction of the intermediate transfer belt 40. Particularly, in a case where the recording medium B has high bending stiffness, the recording medium B tends to move toward the intermediate transfer belt 40 at a position upstream from the contact area PR in the rotating direction of the intermediate transfer belt 40 but the movement is regulated by the upper guide 14. The recording medium B moves toward a position downstream in the rotating direction of the intermediate transfer belt 40 which is closer to the contact area PR, along the intermediate transfer belt 40, in accordance with the regulation of the movement of the recording medium B by the upper guide 14. The recording medium B comes into close contact with the intermediate transfer belt 40 at a position of the contact area PR and moves toward the secondary transfer nip portion T2. In this manner, according to the disposition of the conveyer guide 200 described above, particularly, of the upper guide 14, even if the recording medium B has high bending stiffness, the guided recording medium B does not enter into a state in which the guided recording medium B collides with the intermediate transfer belt 40 and is bent. When the recording medium B does not enter into the state of being bent, the recording medium B does not strongly collide with the intermediate transfer belt 40 and the unfixed toner image carried on the intermediate transfer belt 40 is not disturbed. Therefore, the "deterioration of graininess" is unlikely to appear on the recording medium after the secondary transfer.

Second Embodiment

Figure 4:
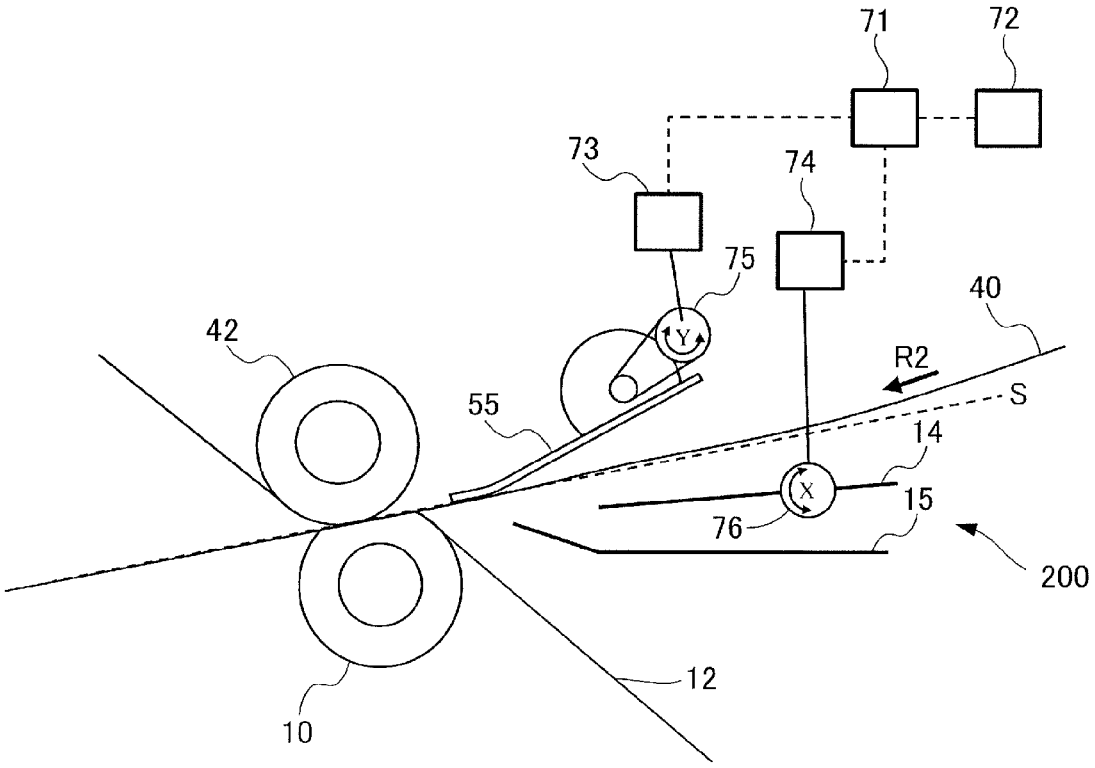
FIG. 4 is a view schematically illustrating a pushing member and a conveyer guide of an image forming apparatus according to a second embodiment.

Next, an image forming apparatus according to a second embodiment of this disclosure will be described with reference to FIG. 4. FIG. 4 is a view schematically illustrating the pushing member and the conveyer guide of the image forming apparatus according to the second embodiment of this disclosure.

In the image forming apparatus according to the second embodiment of this disclosure, it is possible to drive the pushing member 55 and to change the pushing amount. As illustrated in FIG. 4, the pushing member 55 is connected to a first drive-pivoting shaft 75. The first drive-pivoting shaft 75 is pivotably attached to the apparatus body. The first drive-pivoting shaft 75 is pivoted in a Y direction in the drawing by a first drive motor 73 as a pushing amount changing unit. When the first drive-pivoting shaft 75 is pivoted by the first drive motor 73, the pushing member 55 pivots with an angle of pivoting changed in accordance with the pivoting of the first drive-pivoting shaft 75. When the pushing member 55 pivots, the tip end 55*a* thereof is displaced with respect to the intermediate transfer belt 40. That is, a posture of the pushing member 55 is determined in accordance with the pivoting of the first drive-pivoting shaft 75 and the pushing amount of the pushing member 55 is determined according to the posture. In FIG. 4, the pushing amount becomes less when the first drive-pivoting shaft 75 pivots in a clockwise direction and the pushing amount becomes greater when the first drive-pivoting shaft 75 pivots in a counterclockwise direction.

In addition, it is possible to change the position of the upper guide 14 by driving the upper guide 14. As illustrated in FIG. 4, the upper guide 14 is connected to a second drive-pivoting shaft 76 as a pivoting shaft. The second drive-pivoting shaft 76 is pivotably attached to the apparatus body. The second drive-pivoting shaft 76 is pivoted in an X direction in the drawing by a second drive motor 74 as a guide-moving unit. When the second drive-pivoting shaft 76 is pivoted by the second drive motor 74, the upper guide 14 pivots with an angle of pivoting changed in accordance with the pivoting of the second drive-pivoting shaft 76 and in a direction in which the upper guide 14 approaches and moves away from the intermediate transfer belt 40. That is, a posture of the upper guide 14 is determined in accordance with the pivoting of the second drive-pivoting shaft 76. The lower guide 15 is connected to the upper guide 14 by a connecting member (not illustrated) and pivots by being synchronized with the pivoting of the upper guide 14. Therefore, the relative positional relationship between the upper guide 14 and the lower guide 15 is not changed. Accordingly, the posture of the upper guide 14 is determined, the posture of the lower guide 15 is also determined and a guide direction of the recording medium B is determined. When the upper guide 14 pivots, the tip end 14*a* thereof is displaced with respect to the intermediate transfer belt 40. In FIG. 4, the tip end 14*a* approaches the intermediate transfer belt 40 in a case where the second drive-pivoting shaft 76 pivots in the clockwise direction, and moves away from the intermediate transfer belt 40 in a case where the second drive-pivoting shaft 76 pivots in the counterclockwise direction.

Figure 5:
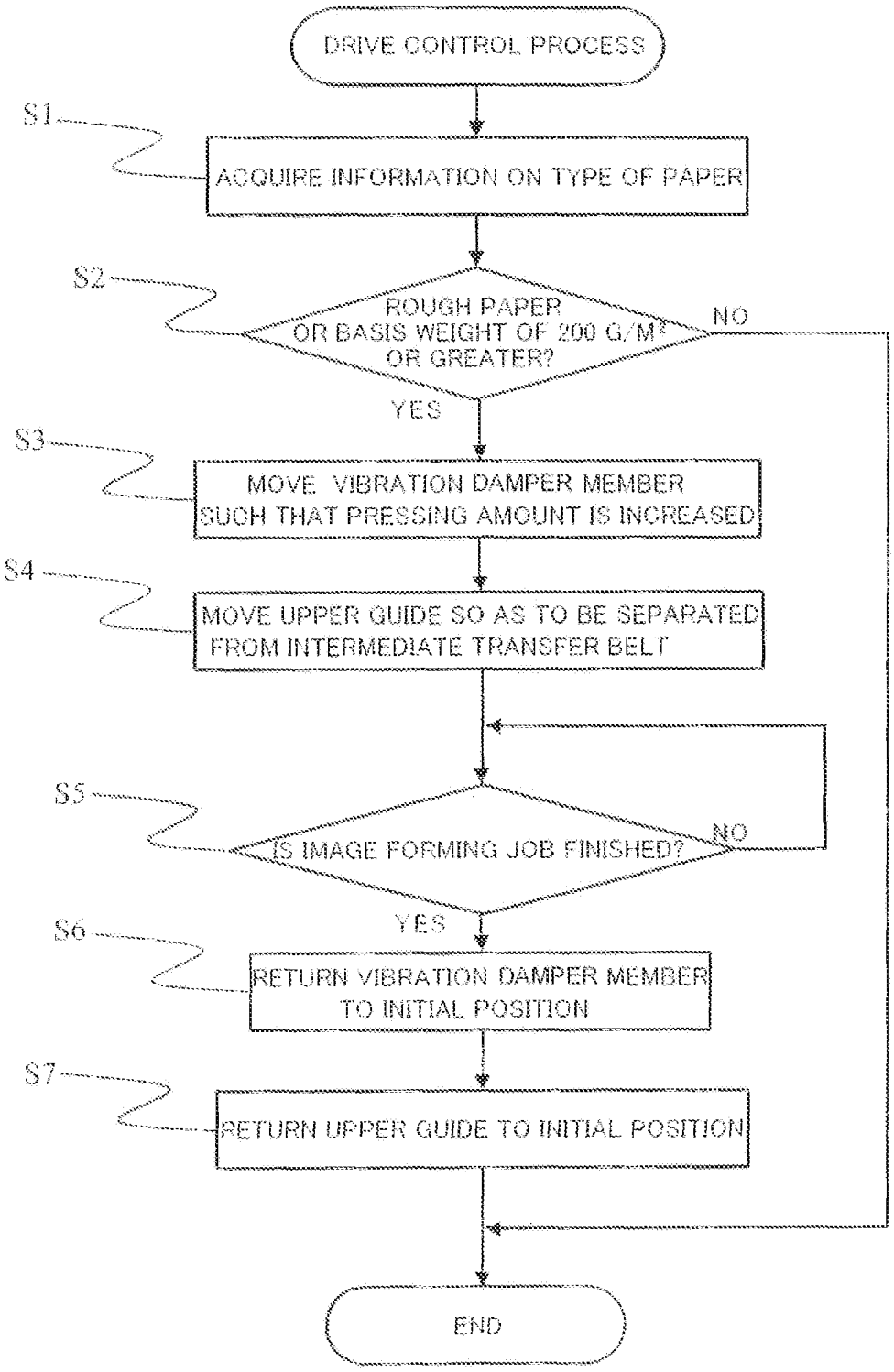
FIG. 5 is a flowchart illustrating a drive control process.

The first drive motor 73 and the second drive motor 74 are controlled by a control unit 71. The control unit 71 includes an acquisition unit 72 and can acquire various types of information items from the acquisition unit 72. The control unit 71 performs a drive control process. The drive control process is described with reference to FIG. 5. FIG. 5 is a flowchart illustrating the drive control process.

As illustrated in FIG. 5, the control unit 71 acquires information on paper types of the recording medium B from the acquisition unit 72 (S1). The information on the paper types is information related to types of the recording medium B and includes, for example, information on a paper type such as rough paper or a basis weight. The control unit 71 determines whether or not the recording medium B is rough paper or cardboard having a basis weight of 200 g/m$^2$ or greater (S2) according to the acquired information on paper types. In a case where the recording medium B is determined not to be rough paper or cardboard having a basis weight of 200 g/m$^2$ or greater (NO in S2), the control unit 71 ends the process. That is, in a case where the recording medium B is not rough paper or cardboard having a basis weight of 200 g/m$^2$ or greater, a gap is unlikely to be formed between the intermediate transfer belt 40 and the recording medium B upstream the secondary transfer nip portion T2. Therefore, in this case, there is no need to increase the pushing amount of the pushing member 55 and to stretch the stretching surface of the intermediate transfer belt 40 to the outer side and thus, the control unit 71 may not drive the first drive motor 73. In addition, when the pushing amount of the pushing member 55 is not increased, there is no need to change the position of the upper guide 14 and thus, the control unit 71 may not drive the second drive motor 74. Thus, the control unit 71 does not drive the first drive motor 73 and the second drive motor 74 and becomes ready for the next image formation with the pushing member 55 and the upper guide 14 remaining at an initial position. The initial position may be a position in a case where the pushing amount is 0 mm or may be a position in a case where the pushing amount is about 0.5 mm to 1.0 mm.

On the other hand, in a case where the recording medium B is determined to be rough paper or cardboard having a basis weight of 200 g/m$^2$ or greater (YES in S2), the control unit 71 causes the pushing member 55 to move in the direction in which the pushing amount is increased (S3). That is, the first drive motor 73 is controlled, the pushing member 55 moves in the direction in which the intermediate transfer belt 40 is pushed, and the pushing amount is increased.

The control unit 71 causes the upper guide 14 to move in the direction in which the upper guide 14 is away from the intermediate transfer belt 40 (S4). In this case, the second drive motor 74 is controlled and the upper guide 14 moves such that the tip end 14*a* of the upper guide 14 is positioned upstream from the furthest downstream pushing position P in the rotating direction of the intermediate transfer belt 40 and on the side further away from the intermediate transfer belt 40 than from the reference line S. Under these conditions, the upper guide 14 may be caused to move in response to an amount of change in the pushing amount. For example, in a case where the pushing amount is changed from 0.5 mm to 1.3 mm, the second drive motor 74 may be controlled such that the position of the upper guide 14 (to be specific, the tip end 14*a*) is away from the intermediate transfer belt 40 by 0.8 mm (1.3-0.5). The amount of change in the pushing amount may vary according to the paper types. That is, in a case where a recording medium has a first basis weight which is greater than a basis weight of a recording medium having a second basis weight, the control unit 71 controls the second drive motor 74 such that the amount of change in the pushing amount is increased to more than that for the recording medium with the second basis weight. For example, the amount of change (for example, 0.8 mm) in the pushing amount in a case where the basis weight is 280 g/m$^2$ as the first basis weight becomes greater than the amount of change (for example, 0.5 mm) in the pushing amount in a case where the basis weight is 250 g/m$^2$ as the second basis weight.

The control unit 71 determines whether or not an image forming job (not illustrated) during a separate operation is ended (S5). In a case where it is determined that the image forming job is not ended (NO in S5), the control unit 71 causes the process not to proceed and to be on standby until the image forming job is ended. In a case where it is determined that the image forming job is ended (YES in S5), the control unit 71 controls both the first drive motor 73 and the second drive motor 74 such that the pushing member 55 and the upper guide 14 return to the initial positions (S6 and S7). After the pushing member 55 and the upper guide 14 return to the initial positions, the control unit 71 ends the process.

As above, in the image forming apparatus according to the second embodiment of this disclosure, it is possible to change the positions of the pushing member 55 and the upper guide 14. Accordingly, the disposition of the conveyer guide 200 described above is maintained even when the pushing amount of the pushing member 55 is changed. Therefore, the recording medium B is nipped in the secondary transfer nip portion T2 and is guided toward the secondary transfer nip portion T2 from the side further away from the intermediate transfer belt 40 than from the reference line S upstream from the furthest downstream pushing position P in the rotating direction of the intermediate transfer belt 40. Accordingly, even though the recording medium B has high bending stiffness, the guided recording medium B does not collide with the intermediate transfer belt 40 and thus, the "deterioration of graininess" is unlikely to appear on the recording medium B after the secondary transfer.

In addition, since the pushing amount of the pushing member 55 can be arbitrarily adjusted according to the types (such as paper types) of recording medium B, it is possible to prolong the service life of the intermediate transfer belt 40 and the pushing member 55. That is, in a case where the recording medium B (for example, paper which has a surface with great unevenness) on which the void is likely to appear is used, the pushing amount of the pushing member 55 may become greater. However, when the pushing amount of the pushing member 55 is great, the intermediate transfer belt 40 and the pushing member 55 strongly collide against each other. Then, the wear of the intermediate transfer belt 40 and the pushing member 55 progresses rapidly. It is possible to arbitrarily adjust the pushing amount of the pushing member 55 according to the types of recording medium B, the pushing amount is greatly changed only when necessary, and thereby, it is possible to prolong the service life of the intermediate transfer belt 40 and the pushing member 55.

Third Embodiment

According to the embodiment described above, the image forming apparatus using the secondary transfer belt 12 is illustrated; however the apparatus is not limited thereto. For example, the image forming apparatus may be configured to have only the secondary transfer roller 10 without the secondary transfer belt 12 and the secondary transfer roller 10 may come into direct contact with the intermediate transfer belt 40 and the secondary transfer nip portion T2 is formed such that the secondary transfer can be performed.

Figure 6:
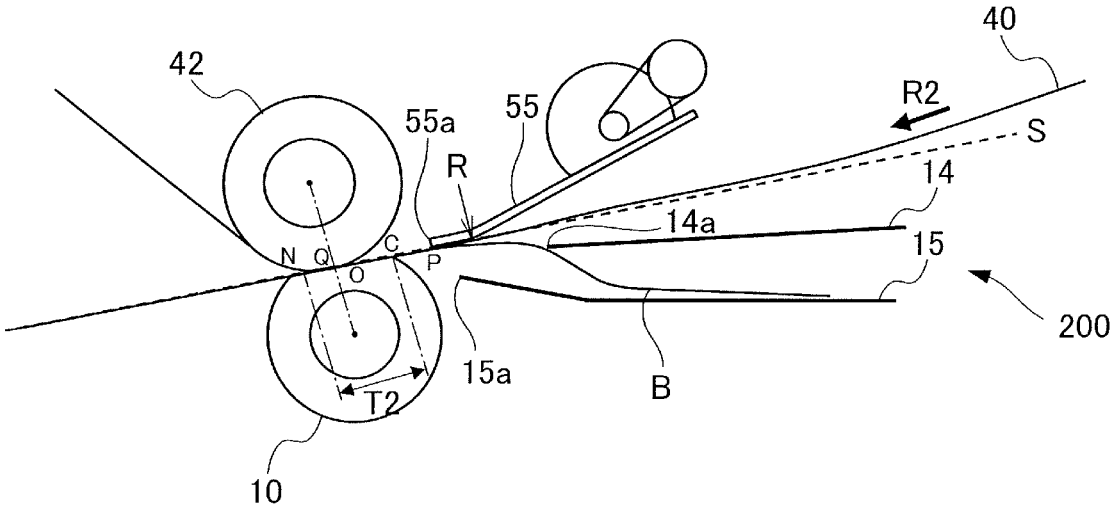
FIG. 6 is a view schematically illustrating a configuration around a secondary transfer nip portion of a third embodiment.

A third embodiment of the present invention will be described with reference to FIG. 6. In the first and second embodiments described above, the configuration forming the secondary transfer nip portion T2 between the intermediate transfer belt 40 and the secondary transfer belt 12 has been described. However, the secondary transfer nip portion T2 is formed by bringing the secondary transfer roller 10 into direct contact with the intermediate transfer belt 40 without using the secondary transfer belt 12 in the present embodiment. Even in the configuration of present embodiment, the image defect such as the void or the like may occur by the recording medium rubbing against the intermediate transfer belt 40. Therefore, the position of the upper guide 14 is restricted in the same manner with that of the first embodiment also in the present embodiment. The other configurations and operations are the same with those of the first embodiment.

Fourth Embodiment

The pushing member 55 is not limited to a sheet member formed to have the plate shape but may be, for example, a roller formed to have a cylindrical shape.

Figure 7:
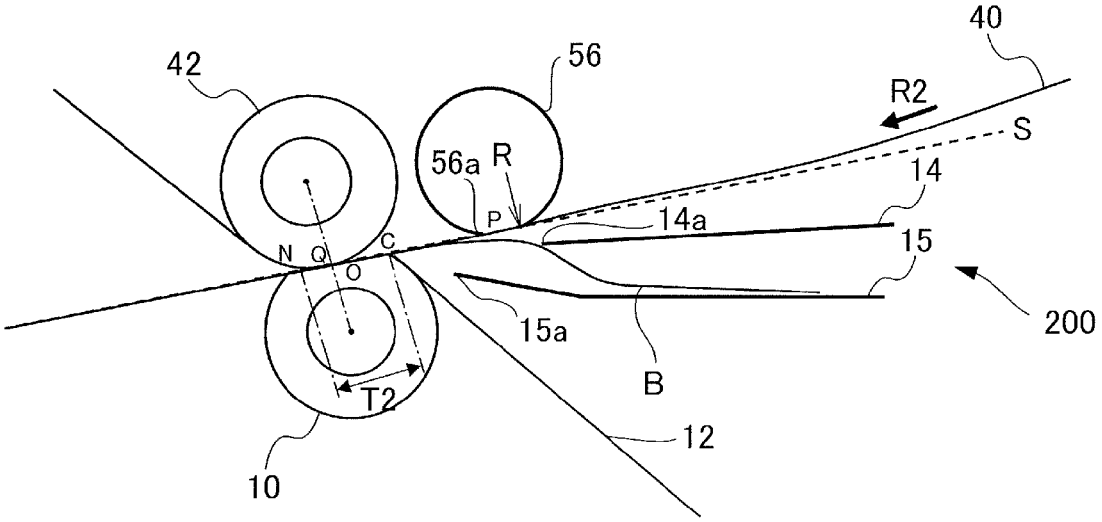
FIG. 7 is a schematic diagram illustrating a configuration around a secondary transfer nip portion of a fourth embodiment.

A fourth embodiment of the present invention will be described with reference to FIG. 7. The member formed into the plate-like shape has been used as the pushing member in the first and second embodiments described above. However, a roller 56 is used as the pushing member in the present embodiment. The roller 56 is a resin-made roller, for example, which has been adjusted to have a middle electric resistance in advance as described in the first embodiment. It is noted that the roller 56 may be adjusted to the middle resistance by providing a thin elastic layer on a surface of a metallic roller. Still further, the roller 56 may be configured to be unrotatable or to be rotatable following the intermediate transfer belt 40.

In the case of the present embodiment, a surface of the roller 56 pushing the intermediate transfer belt 40 comes into contact with the intermediate transfer belt 40 with a predetermined length along the rotation direction of the intermediate transfer belt 40. In this case, the upper guide 14 is provided with its tip end 14*a* to be positioned on the side further away from the intermediate transfer belt 40 than from the reference line S that connects the position Q and a furthest downstream pushing position 56*a* of a contact area of the roller 56. The other configurations and operations of the present embodiment are the same with those of the first and second embodiments. It is noted that the configuration of the present embodiment may be applied to the configuration including the secondary transfer belt 12 similarly to the first and second embodiments.

In addition, this invention is not limited to the horizontal transport type image forming apparatus in which the recording medium B is transported in a horizontal direction with respect to a ground contact surface of the apparatus body as illustrated in FIG. 1 but may include a vertical transport type image forming apparatus in which the recording medium B is transported in a vertical direction with respect to the ground contact surface of the apparatus body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-090097, filed Apr. 24, 2014, and 2015-031159, filed Feb. 19, 2015 which are hereby incorporated by reference herein in their entirety.

What is claimed is:

1. An image forming apparatus comprising:

an endless image carrying belt rotating while carrying a toner image on a surface thereof;

an inner-side roller provided on the inner circumferential side of the image carrying belt and coming into contact with the image carrying belt;

a stretching member provided upstream, with respect to a rotating direction of the image carrying belt, of the inner-side roller and stretching the image carrying belt from the inner circumferential side;

a pushing member having a plate shape and provided upstream of the inner-side roller and downstream of the stretching member with respect to the rotating direction of the image carrying belt, and coming into contact with and pushing the image carrying belt from the inner circumferential side such that a stretching surface of the image carrying belt which is formed between the inner-side roller and the stretching member is jutted to the outer side;

an outer-side roller provided to face the inner-side roller with the image carrying belt nipped therebetween, forming a transfer nip portion with the inner-side roller, and transferring the toner image onto a recording medium from the image carrying belt while the recording medium is nipped and conveyed at the transfer nip portion; and a guide member guiding the recording medium toward the transfer nip portion, the guide member including:

a first guide provided upstream of the transfer nip portion with respect to the rotating direction of the image carrying belt and on the outer side of the image carrying belt; and a second guide provided between the first guide and the image carrying belt and of which a tip end on the side of the transfer nip portion is positioned further away from the image carrying belt than from a reference line that connects a point at which a line connecting the rotational center of the inner-side roller and the rotational center of the outer-side roller intersects with the image carrying belt, and a furthest downstream contact point of a contact area in which the pushing member contacts with the image carrying belt.

2. The image forming apparatus according to claim 1, further comprising a pushing amount changing unit configured to change a pushing amount of the pushing member against the image carrying belt, wherein the second guide is configured such that the tip end on the side of the transfer nip portion is positioned further away from the image carrying belt than from the reference line, regardless of a position of the stretching surface of the image carrying belt which is changed depending on the pushing amount of the pushing member by the pushing amount changing unit.

3. The image forming apparatus according to claim 2, further comprising:

a guide-moving unit configured to change at least a position of the second guide of the guide member; and a control unit configured to control the guide-moving unit such that the position of the second guide is changed depending on the pushing amount of the pushing member by the pushing amount changing unit.

4. The image forming apparatus according to claim 3, wherein the control unit controls the pushing amount changing unit such that the pushing amount of the pushing member is changed in accordance with a type of recording medium.

5. The image forming apparatus according to claim 4, wherein in a case where a recording medium has a first basis weight which is greater than a basis weight of a recording medium having a second basis weight, the control unit controls the pushing amount changing unit such that the pushing amount of the pushing member becomes greater than that in a case of the recording medium having the second basis weight.

6. The image forming apparatus according to claim 3, wherein the second guide is provided to be pivotable about a pivoting shaft, and the guide-moving unit changes the position of the second guide such that the tip end on the side of the transfer nip portion is positioned further away from the image carrying belt than from the reference line by changing an angle of pivoting of the second guide about the pivoting shaft.

7. The image forming apparatus according to claim 1, wherein the outer-side roller is a resilient roller that has a resilient layer and directly comes into contact with the image carrying belt.

8. The image forming apparatus according to claim 1, further comprising an endless transfer belt stretched by the outer-side roller, wherein the outer-side roller is provided to face the inner-side roller with the transfer belt and the image carrying belt nipped therebetween.

* * * * *